United States Patent [19]

Balin

[11] Patent Number: 4,905,864

[45] Date of Patent: Mar. 6, 1990

[54] FIBREBOARD SHEET AND BLANK AND METHOD FOR PRODUCING SAME

[75] Inventor: Chaim Balin, Ramat Chen, Israel

[73] Assignee: Carmel Container Systems Limited, Tel-Aviv, Israel

[21] Appl. No.: 217,071

[22] Filed: Jul. 8, 1988

Related U.S. Application Data

Continuation of Ser. No. 001.826 filed Jan. 9, 1987.

[30] Foreign Application Priority Data

Jan. 19, 1986 [IL] Israel ..... 77643

[51] Int. Cl.[4] ..... B65D 5/56

[52] U.S. Cl. ..... 220/441; 220/416; 229/DIG. 2; 229/DIG. 4

[58] Field of Search ..... 229/132, DIG. 2, DIG. 4, 229/919; 220/441, 416, 443

[56] References Cited

U.S. PATENT DOCUMENTS

| | | | |
|---|---|---|---|
| 1,912,698 | 6/1933 | Forsman | 229/DIG. 2 |
| 2,075,679 | 3/1937 | Weber | 229/DIG. 2 |
| 2,317,773 | 4/1943 | Kavanaugh | 229/DIG. 2 |
| 2,324,757 | 7/1943 | Botley | 229/DIG. 2 |
| 2,330,294 | 9/1943 | Leavitt et al. | 229/DIG. 2 |
| 2,710,134 | 6/1955 | Schroeder et al. | 229/132 |
| 2,857,091 | 10/1958 | Enzie | 220/441 |
| 3,361,326 | 1/1968 | Croley et al. | 229/132 |
| 4,177,936 | 12/1979 | Ford, Jr. et al. | 220/441 |

FOREIGN PATENT DOCUMENTS

| | | | |
|---|---|---|---|
| 534925 | 2/1955 | Belgium | 229/DIG. 2 |
| 2433721 | 1/1976 | Fed. Rep. of Germany | 229/441 |
| 977069 | 12/1964 | United Kingdom | 229/DIG. 4 |

*Primary Examiner*—Gary Elkins

*Attorney, Agent, or Firm*—Sandler & Greenblum

[57] ABSTRACT

A fibreboard sheet made of corrugated or solid fibreboard for the preparation of blanks for fibreboard articles having, in integral layout, at least two sections having different thicknesses. A blank for a fibreboard container is also provided. The blank consists of, in integral layout, at least two side panels and two end panels, with the panels being designed to constitute the vertical walls of the fibreboard container when assembled, and at least two flaps, designed to constitute at least one surface of the container when assembled. The thickness of the fibreboard structure of the panels is greater than the thickness of the fibreboard structure of at least the major portion of the flaps. A method for producing a fibreboard sheet of corrugated fibreboard is also described.

2 Claims, 3 Drawing Sheets

FIBREBOARD SHEET AND BLANK AND METHOD FOR PRODUCING SAME

This application is a continuation of application Serial No. 001,826, filed Jan. 9, 1987 now abandoned.

The present invention relates to a fibreboard sheet and blank for a container such as is used for shipping and storing of goods.

There are very good reasons why fibreboard containers, especially corrugated fibreboard containers, have become popular to the point where, in industrialized countries, 90 to 95% of all packaged goods are shipped as well as stored in corrugated fibreboard containers: these containers are relatively cheap and light, yet withstand the rigors of rough handling associated with transport in all its forms, while giving full protection to their contents. Perhaps most important, they can be designed to have great stacking strength, that is, to resist bulging and buckling under the cumulative weight of a reasonable number of other full containers stacked on top of them.

The remarkable strength of corrugated fibreboard containers is obviously due to the special configuration of this type of fibreboard: the sinusoidal cross section providing strength in a direction perpendicular to the board surface, and the column effect of the corrugations providing stength in a direction along the corrugations.

The basic corrugated fibreboard structure is the so-called Single Face Corrugated, which is produced by gluing a flat sheet of paperboard, the so-called facing, to a sheet of corrugated paperboard. By itself, this type of structure serves mainly for wrapping of fragile articles, because of its cushioning effect. However, it constitutes the initial stage in the production of the so-called single Wall Corrugated, which consists of the above Single Face Corrugated, to the corrugation side of which another facing has been glued. The great majority of containers are made from this type of board. The height, number per unit length of board and minimum crushing strength (unit force/unit area) of the corrugations or flutes, as they are also called, are standardized and designated K, A, B, C and E, with K denoting the greatest height, smallest number per unit length and lowest strength, and E denoting the lowest height, largest number per unit length and greatest crushing strength.

For greater stacking strength it is possible to use the Double Wall Corrugated, which consists of a Single Wall Corrugated to which has been added another corrugated member topped by another facing, altogether five components, in sequence: a first facing, a first corrugation, a second facing, a second corrugation, and a third facing. Still greater strength is provided by the Triple Wall Corrugated, in which another corrugated member and a further flat facing are added to the Double Wall Corrugated. While single wall corrugated fibreboard is available in A, B, C and E style, double wall board is normally available in AB, CB, AA and AC combinations, and triple wall (also: tri-wall) board in AAB, CCB and BAE combinations.

It is thus seen that the stacking strength of corrugated fibreboard containers can be increased by making them of multi- instead of single-wall corrugated fibreboard. However, since the compressive forces produced by stacking act almost exclusively on the vertical walls - the so-called panels of the container, while hardly affecting the so-called flaps that constitute the container bottoms and tops, and since in prior-art container blanks, blank strength can be modified only over the entire blank area, it is clear that switching from a single-wall to a double-wall configuration to increase the stacking strength of a container would, by increasing the thickness not only of the panels, but also of the flaps, entail a considerable waste of material, as the flaps would do perfectly also in a single-wall configuration.

It is one of the objects of the present invention to overcome this draw-back of the prior-art fibre-board container blanks by providing a container blank, producible on conventional corrugators easily modified for the purpose, which blank can be made with different wall configurations at different portions thereof, for instance with a multi-wall configuration over those portions that define the container panels, and a single-wall configuration over those portions that define the container flaps, thereby enabling fibreboard economies amounting to 10–20%.

This the invention achieves by providing a fibreboard sheet made of corrugated or solid fibreboard for the preparation of blanks for fibreboard containers comprising, in integral layout, at least two sections having different thicknesses.

The invention further provides a blank for a fibreboard container comprising, in integral layout, at least two side panels and two end panels, said panels being designed to constitute the vertical walls of said fibreboard container when assembled, and at least two flaps, said flaps being designed to constitute at least one surface of said container when assembled, wherein the thickness of the fibreboard structure of said panels is greater than the thickness of the fibreboard structure of at least the major portion of said flaps.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the Drawings:

FIG. 1 presents a prior-art blank for an RSC-type container;

Figure 1:
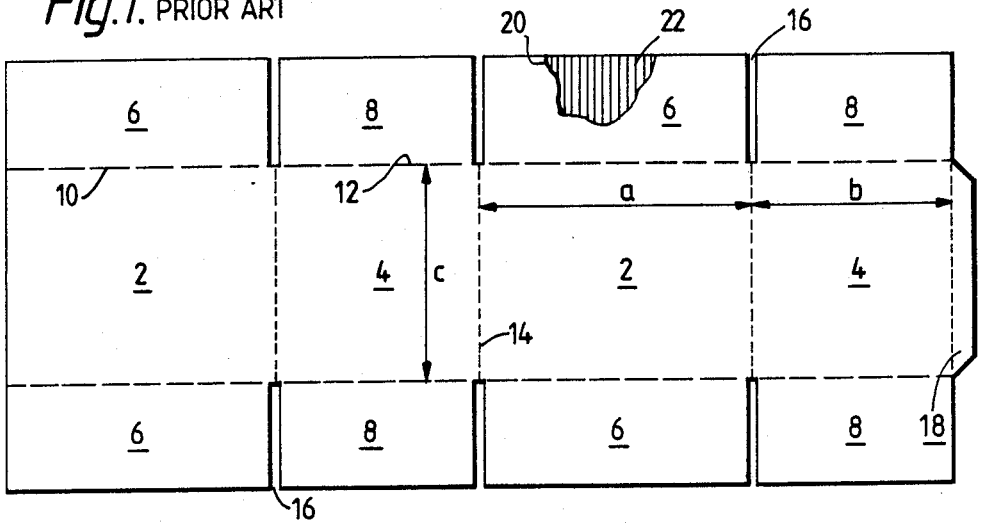
Fig.1. PRIOR ART

Referring now to the drawings, there is represented in FIG. 1, mainly for the purpose of introducing the standardized container terminology, the prior-art blank of an RSC-type container (RSC = Regular Slotted Container). There are seen two side panels 2 and two end panels 4 which, in the assembled state of the container, constitute the vertical walls thereof. Further seen are four side flaps 6, and four end flaps 8 which between them constitute the bottom and top of the set-up container. Accurate folding is facilitated by so-called scores (represented by the dashed lines) which are impressions or creases in the fibreboard prepared during the blank-making process. There are seen horizontal side scores 10, horizontal end scores 12, and vertical scores 14. The flaps on each side of the panels are separated by slots 16 (hence "slotted container"). Further provided is a joining tab 18 which, upon assembly of the container, is glued or stitched to the free vertical edge of the side panel 2 on the left. The dimensions a, b and c indicate the length, width and depth, respectively, of the assembled container. In one of the upper flaps 6 part of the facing 20 has been removed to show the orientation of the corrugations 22 relative to the scores.

Figure 2:
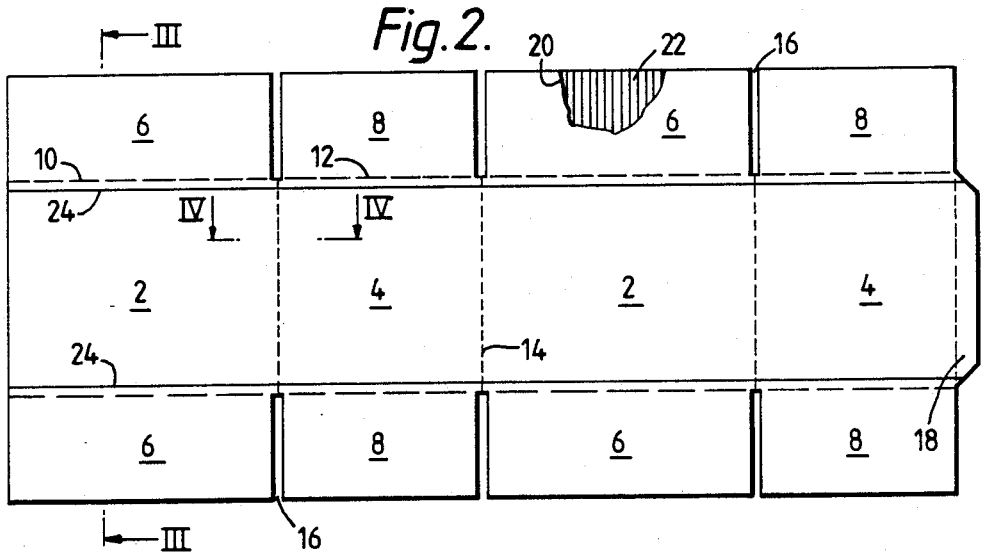
FIG. 2 shows the blank according to the invention for the same type of container.
Figure 3:
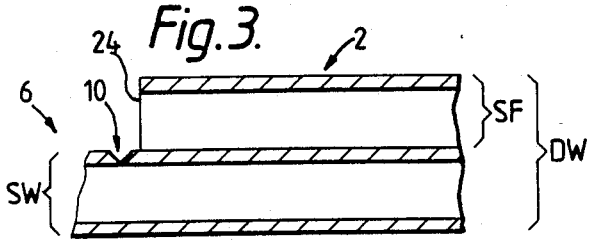
FIG. 3 is a partial view, greatly enlarged and in cross section along plane III—III in FIG. 2, of the blank of FIG. 2.
Figure 4:
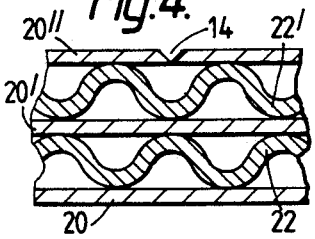
FIG. 4 is a similar view, but along plane IV—IV of FIG. 2.

FIG. 2 shows part of a blank according to the invention, designed for the same RSC-type container and FIG. 3 represents a partial view, greatly enlarged and in cross section along plane III—III of FIG. 2, of the blank shown in FIG. 2. It is seen that while the entire blank has a common single-wall corrugated fibreboard layer SW which constitutes the flaps 6 and 8 as well as the outside layer of the panels 2 and 4, these panels have been reinforced by a single-face layer SF limited in its outline to the outline of the side and end panels 2 and 4 and constituting, together with the common single-wall layer SW a double-wall structure SW. The edge 24 of the SF-layer is close to the score 10. The structure of the DW portion is clearly shown in FIG. 4 and is seen to be comprised of a first outer facing 20, a first corrugated member 22, a center facing 20', a second corrugated member 22' and a second outer facing 20''. In this particular example, the two corrugated members are of the same type, e.g., both A.

Figure 5:
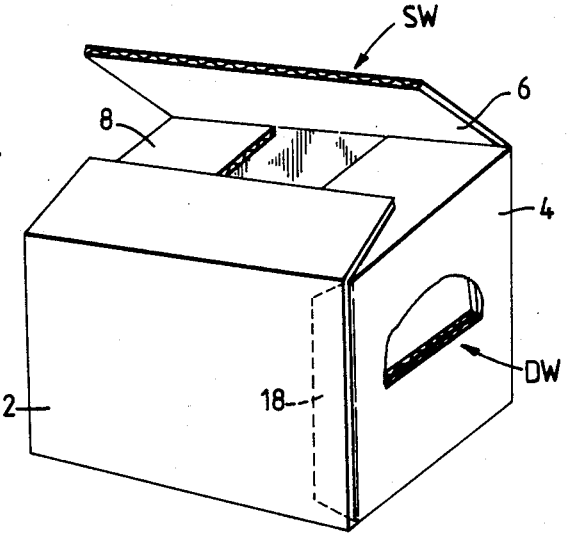
FIG. 5 is a perspective view of an assembled container made from the blank of FIG. 2.

The assembled container as made from the blank of FIG. 2 is shown in FIG. 5, where the single-wall (SW) and double-wall (DW) portions are clearly distinguished.

Figure 6:
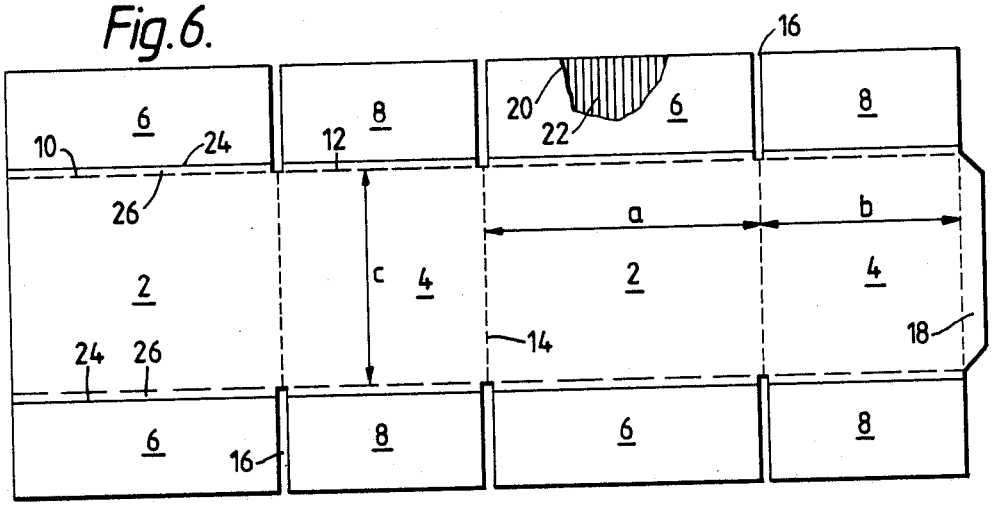
FIG. 6 is a variant of the blank of FIG. 2.
Figure 7:
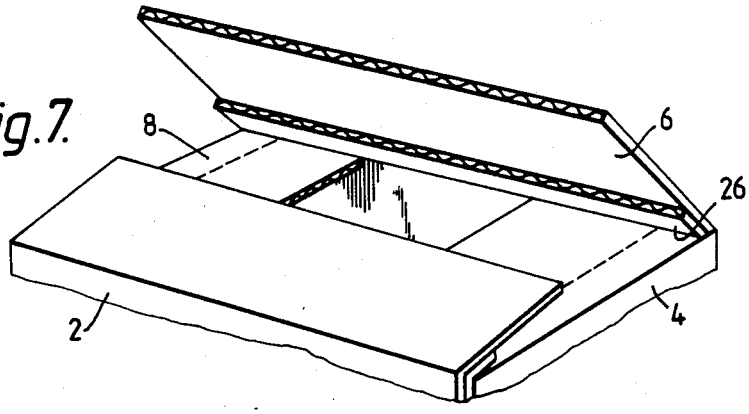
FIG. 7 is a perspective, partial view of an assembled container made from the blank of FIG. 6.

A varient of the blank of FIG. 2 is shown in FIG. 6. Here the width of the SF-layer, i.e., the distance between the SF-layer edges 24, exceeds the distance between the horizontal scores 10, 12, these scores being located on the facing 20'' (FIG. 4) of the SF-layer. Consequently, when the blank is folded, the marginal strips 26 of the SF-layer are folded along the scores 10, 12, together with the flaps 6, 8, and thus constitute flange-like reinforcements which enhance stacking strength even further. Part of a container made from the blank of FIG. 6 is shown in FIG. 7.

While the examples given related to an RSC-type container the invention is applicable to other types as well, such as CSSC, FOL, CSO, OSC, HSC, PTHS, FTHS and others, including containers made of solid, rather than corrugated, fibreboard, non-rectangular containers, fibre drums, etc.

Figure 8:
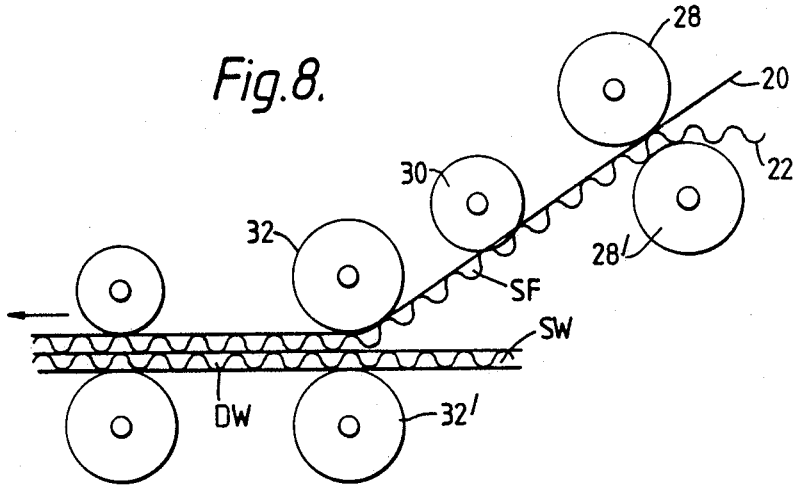
FIG. 8 is a schematic elevational view of a corrugator section modified to produce blanks according to the inventio.
Figure 9:
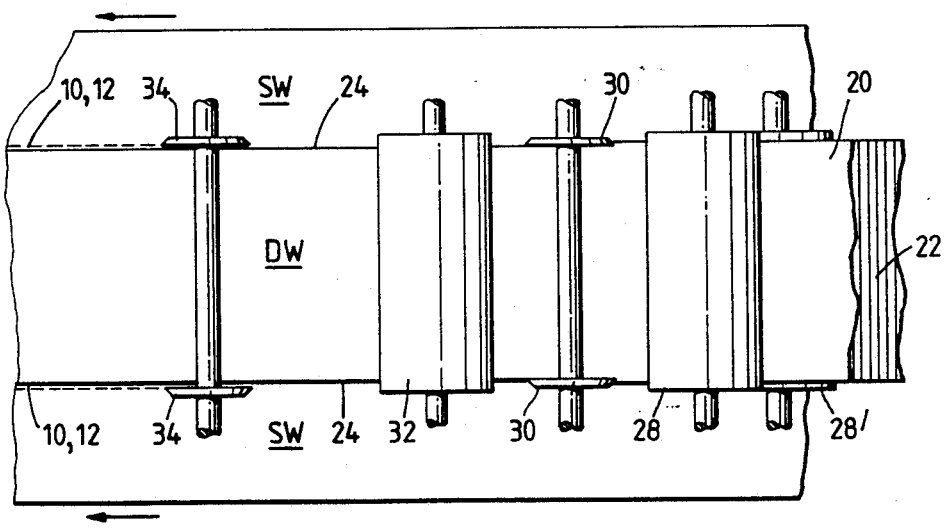
FIG. 9 is a top view of the corrugator section of FIG. 8.

FIGS. 8 and 9 are schematic representations showing the work stations of a corrugator modified to produce a blank according to the invention, as seen in FIG. 2.

The starting material for this corrugator section is the single-wall corrugated fibreboard layer SW, common to the flap (6,8) and the panel (2,4) sections of the blank. This layer SW comes, cut to width, from the so-called "double backer" section of the corrugator.

As a first step towards the finished blank, a single-face layer SF is produced with the aid of gluing rolls 28, 28' from webs of flat paperboard for the facing 20, and the fluted web for the corrugated member 22. The SF-layer thus produced is cut to exact size (=the depth of the assembled container) by means of a pair of rotary knives 30 that produce the edges 24 of FIG. 2, and moves on to the next station in which another pair of glueing rolls 32, 32' is used to glue the single-face strip or web SF to the common single-wall layer SW, to form together with the latter the double-wall layer DW which, in the assembled container, will constitute the vertical walls or panels 2 and 4.

In the next station a rotary scoring tool 34 is used to prepare the set of so-called machine-direction scores, which correspond to the horizontal side and end scores 10 and 12 of FIG. 2. The set of transverse or cross-direction scores 14 is produced in the next section of the corrugator, which provides also the slot 16.

Depending on the width of th blank and the capacity of the corrugator, it is also possible to process SW-layer having twice the width of the blank, and attach to it two separate SF-strips and, at a further station, split this twin blank lengthwise, thereby fully utilizing the capacity of the corrugator.

Instead of preparing the SW-strip at the work station illustated in FIG. 8, it would also be possible to draw the SF-strip readymade from a reel.

For special-purpose containers it would also be advantageous to use instead of the SF-layer, or in addition thereto, a layer of simple corrugated medium without facing.

While the above indicated modifications are compatible with most types of container-producing machinery existing, the blank according to the invention can obviously be produced also by machinery that would require different modifications and methods.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A blank for a corrugated fibreboard container comprising, in integral layout:

(a) a first blank member made of single-wall corrugated fibreboard comprised of two outer layers of paperboard facing glued to, and enclosing a central layer of corrugating material, and defining at least two side panels, two end panels, and at least two flaps, said panels being designed to constitute at least parts of the vertical walls of said container when assembled, said at least two flaps being designated to constitute horiztonal surface of the container when assembled.

(b) at least one second blank member made of single-face corrugated fibreboard comprised of a first layer of corrugating material glued to a second layer of paperboard facing, said first layer of said second blank member being glued to an outer layer of said first blank member;

(c) each of said first and second blank members having machine-direction edges and transversely directed cross-direction edges, the distances between the respective cross-direction edges of said first and second blank members constituting the lengths thereof which are substantially identical;

(d) the distance between the machine-direction edges of said second member being its width which is substantially smaller than the distance between the machine-direction edges of said first member;

(e) said second member having at least one machine-direction score line on said second layer adjacent a machine-direction edge of said second member for defining a relatively narrow strip of second member material covering a portion of said flaps of said first member and defining one horizontal inside end of said panels of said container when assembled;

(f) the corrugating material of said second member extending substantially up to the machine-direction edges and its integrity being preserved in said strip which lies between said score line on said second layer of said second member and the machine direction edge thereof adjacent the score line.

2. A blank according to claim 1 further comprising a plurality of cross-direction score lines that define borders between at least some of said panels and a plurality of slots that define borders between at least some of said flaps.

* * * * *